US009625126B2

(12) United States Patent
Adinolfi et al.

(10) Patent No.: US 9,625,126 B2
(45) Date of Patent: Apr. 18, 2017

(54) LUMINAIRE WITH REMOVABLE LIGHTING MODULES

(71) Applicants: John Thomas Adinolfi, Milltown, NJ (US); Michael Eugene McGehee, Jarrettsville, MD (US)

(72) Inventors: John Thomas Adinolfi, Milltown, NJ (US); Michael Eugene McGehee, Jarrettsville, MD (US)

( * ) Notice: Subject to any disclaimer, the term of this patent is extended or adjusted under 35 U.S.C. 154(b) by 0 days.

(21) Appl. No.: 14/451,852

(22) Filed: Aug. 5, 2014

(65) Prior Publication Data

US 2015/0055341 A1 Feb. 26, 2015

Related U.S. Application Data

(60) Provisional application No. 61/862,224, filed on Aug. 5, 2013.

(51) Int. Cl.

| | |
|---|---|
| ***F21V 15/01*** | (2006.01) |
| ***F21S 2/00*** | (2016.01) |
| ***F21V 21/116*** | (2006.01) |
| *F21Y 101/00* | (2016.01) |
| *F21K 9/20* | (2016.01) |

(52) U.S. Cl.

CPC ..... *F21V 15/01* (2013.01); *F21S 2/005* (2013.01); *F21V 21/116* (2013.01); *F21K 9/20* (2016.08); *F21Y 2101/00* (2013.01)

(58) Field of Classification Search

CPC ..... B60Q 1/2665; B60Q 3/023; F21V 15/01; F21V 21/30; F21V 21/088; F21V 21/116; F21V 21/14; F21V 17/16; F21V 19/004; F21V 21/145; F21V 23/008; F21V 29/004; F21Y 2103/003; F21Y 2105/001; F21Y 2105/10; F21W 2131/105; F21W 2131/107; F21W 2131/10; G02B 2027/0118; F21S 2/005; F21S 48/1122; F21S 48/115

See application file for complete search history.

(56) References Cited

U.S. PATENT DOCUMENTS

| | | | | |
|---|---|---|---|---|
| 5,938,317 | A * | 8/1999 | Thornton | F21V 11/02 362/290 |
| 7,651,245 | B2 * | 1/2010 | Thomas | F21V 15/01 362/249.02 |
| 8,072,318 | B2 * | 12/2011 | Lynam | B60K 35/00 340/425.5 |
| 2010/0014289 | A1 * | 1/2010 | Thomas | F21V 15/01 362/235 |
| 2011/0051420 | A1 * | 3/2011 | Gill | F21S 8/086 362/249.03 |
| 2012/0162980 | A1 * | 6/2012 | Mrakovich | F21V 23/003 362/235 |

(Continued)

*Primary Examiner* — Hargobind S Sawhney
(74) *Attorney, Agent, or Firm* — NSIP Law

(57) ABSTRACT

There is provided a luminaire apparatus for illuminating an object. The luminaire apparatus may also include a light module housing that is to be substantially parallel to the object and includes a light module recess. Further, the luminaire apparatus includes lighting module configured to be disposed within the light module recess and configured to be oriented substantially parallel to the object. Additionally, the luminaire apparatus includes a housing mounting member configured to be attached to the light module housing.

6 Claims, 16 Drawing Sheets

(56) References Cited

U.S. PATENT DOCUMENTS

| | | | | |
|---|---|---|---|---|
| 2012/0218757 | A1* | 8/2012 | Gill | F21S 4/008 362/235 |
| 2013/0063937 | A1* | 3/2013 | Ahn | F21V 29/2293 362/235 |
| 2013/0265780 | A1* | 10/2013 | Choksi | F21V 29/2206 362/373 |

* cited by examiner

LUMINAIRE WITH REMOVABLE LIGHTING MODULES

CROSS-REFERENCE TO RELATED APPLICATION(S)

This application claims the priority benefit under 35 U.S.C. §119 to U.S. Provisional Application No. 61/862,224, filed on Aug. 5, 2013, in the U.S. Patent and Trademark Office.

BACKGROUND

1. Field

The following description relates to general, commercial, and industrial illumination, and more particularly, to a luminaire utilized for illuminating general, commercial, and industrial various objects from an affixed location.

2. Description of the Related Art

Luminaires are implemented in a variety of general purpose, industrial, and commercial illumination environments, such as the illumination of billboards, parking walls, warehouse walls, retail space walls, outdoor signs and the like. Luminaires of this nature must operate in harsh environments and be effectively impervious to the elements including rain, wind, snow, and ambient temperatures.

Existing industry luminaires developed for illumination of outdoor signs and the like have with varying effectiveness addressed the requirement of producing an illumination level of an intensity sufficient to allow the outdoor sign to be viewed with comprehension from varying distances. Existing industry luminaires products include a plurality of light emitting diodes (LEDs) that are individually pointed at the outdoor sign at various angles to illuminate the surface. For example, the plurality of LEDs may be individually pointed towards the outdoor sign at a forty-five degree angle or may be pointed at an upward ninety degree angle in order to illuminate the outdoor sign, or even pointed across the outdoor sign from either side of the outdoor sign. However, with any of these configurations, the plurality of LEDs may only be able to illuminate a portion of the surface of the outdoor sign.

Moreover, existing industry luminaires products are not modular and hence repairs require removal of the entire fixture from a billboard which is expensive and time-consuming. These existing luminaires products generally emit light from a light surface facing the billboard by laying horizontal with the lenses of the luminaire directing light upward to the billboard or angling the entire luminaire towards the billboard at or approximately a forty five degree angle, However, these types of luminaire arrangements are not the most efficient in providing ample light to read the entirety of the billboard and are commonly susceptible to interference from environmental surroundings such as leaves and snow.

As such, a configuration is needed to provide an efficient improvement in illuminating an entire surface of an outdoor sign during normal and harsh weather environments.

SUMMARY

In one general aspect, there is provided a luminaire apparatus for illuminating an object. The luminaire apparatus may also include a light module housing that is to be substantially parallel to the object and includes a light module recess. Further, the luminaire apparatus includes lighting module configured to be disposed within the light module recess and configured to be oriented substantially parallel to the object. Additionally, the luminaire apparatus includes a housing mounting member configured to be attached to the light module housing and a connection member configured to connect the object to the housing mounting member.

In another general aspect, there is provided a luminaire apparatus for illuminating an object that includes a light module housing. The luminaire apparatus may also include a lighting module configured to be releasably attached to the light module housing. Further, the luminaire apparatus includes a plurality of light emitting diodes (LEDs) disposed within the lighting module and a light emitting surface affixed to the lighting module. Additionally, the light module housing, the lighting module, and the light emitting surface is configured to be oriented substantially vertically and to be oriented substantially parallel to the object. Moreover, the plurality of LEDs in the luminaire apparatus emit light through the light emitting surface without interference from a surrounding environment.

In yet another general aspect, a method is described for installing a luminaire apparatus that may include attaching a light module housing to the connection member. The method may also include inserting a light module into the light module housing such that a light emitting surface of the light module is oriented substantially parallel to the object and the light module is configured to illuminate an entirety of the object.

BRIEF DESCRIPTION OF THE DRAWINGS

These and/or other aspects will become apparent and more readily appreciated from the following description of the embodiments, taken in conjunction with the accompanying drawings in which.

Figure 1:
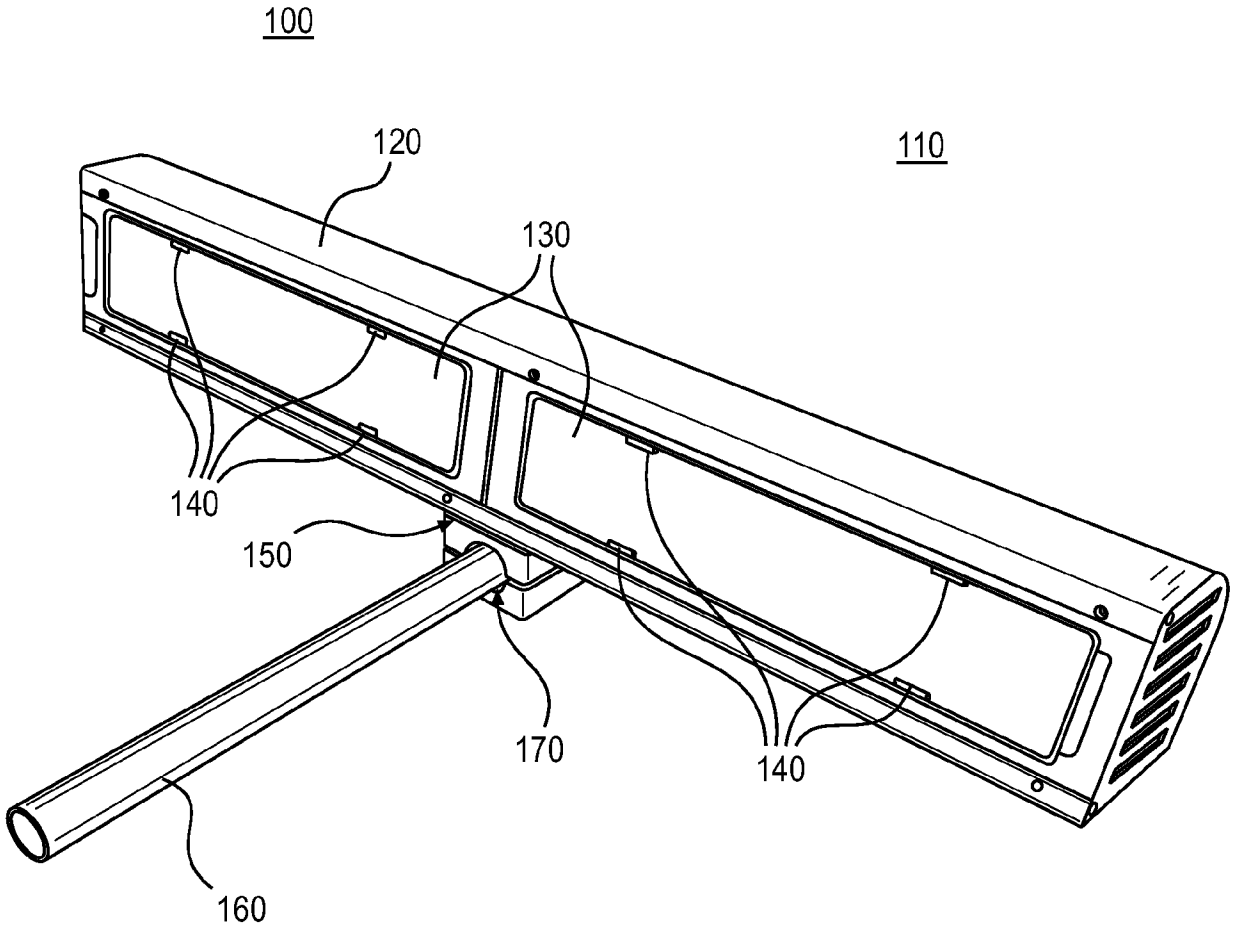
FIG. 1 illustrates a plan view example of a luminaire apparatus with removable lighting modules.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

A luminaire apparatus 110 includes a light module housing 120, a plurality of light modules 130, and a housing mounting member 150. The light module housing 120, the plurality of light modules 130, and the housing mounting member 150 may be fabricated as modules by any one of a different number of fabrication techniques associated with fabrication of a luminaire or other similar illuminating device. As noted above, luminaries are utilized for illuminating general, commercial, and industrial various objects from an affixed location. The modularity of the approach discussed below allows for continuous upgrades as luminaire technology improves, such as when low power modules that may affix to the luminaire become available.

Figure 2:
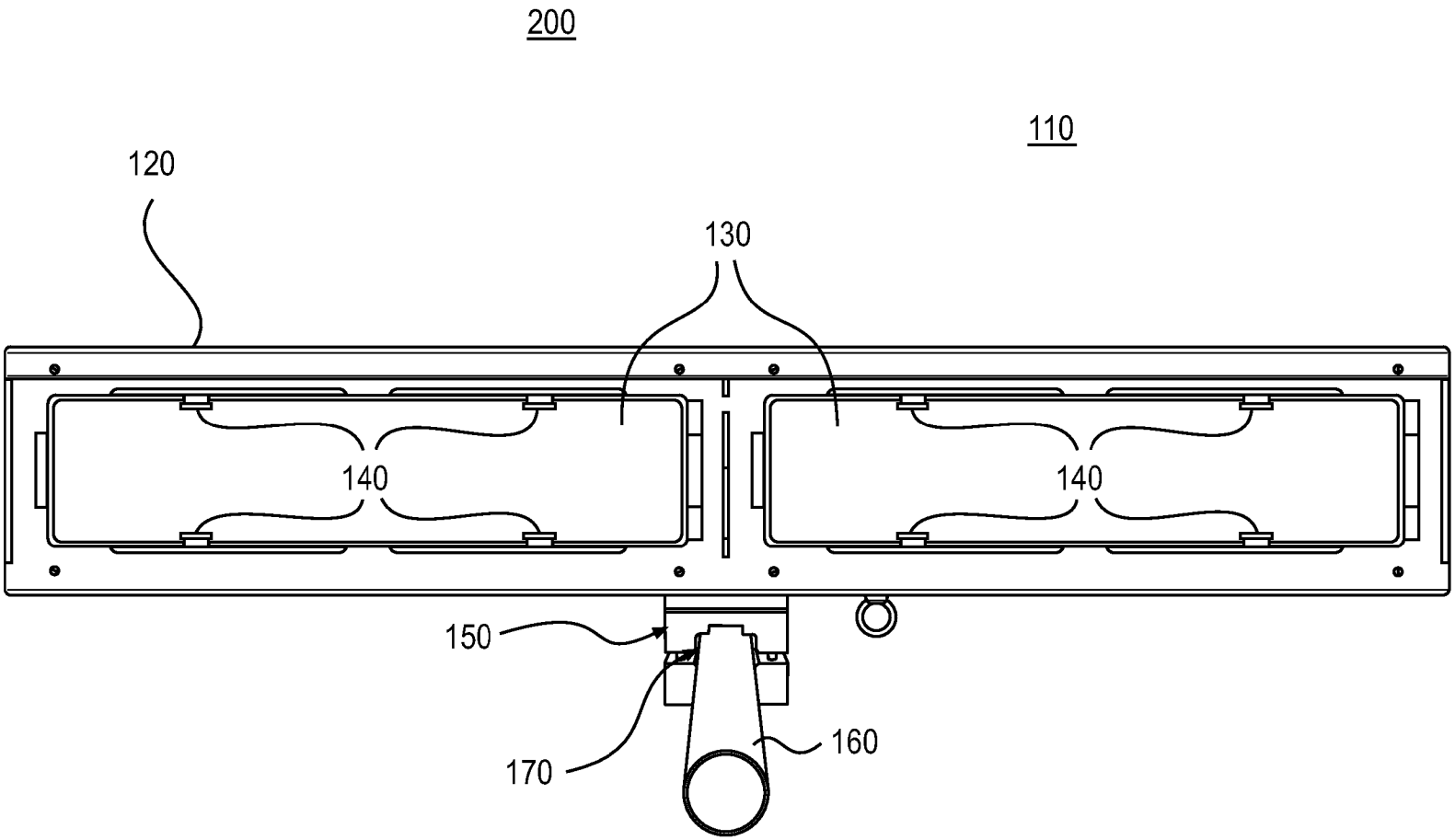
FIG. 2 illustrates a front plan view example of a luminaire apparatus with removable lighting modules.
Figure 3:
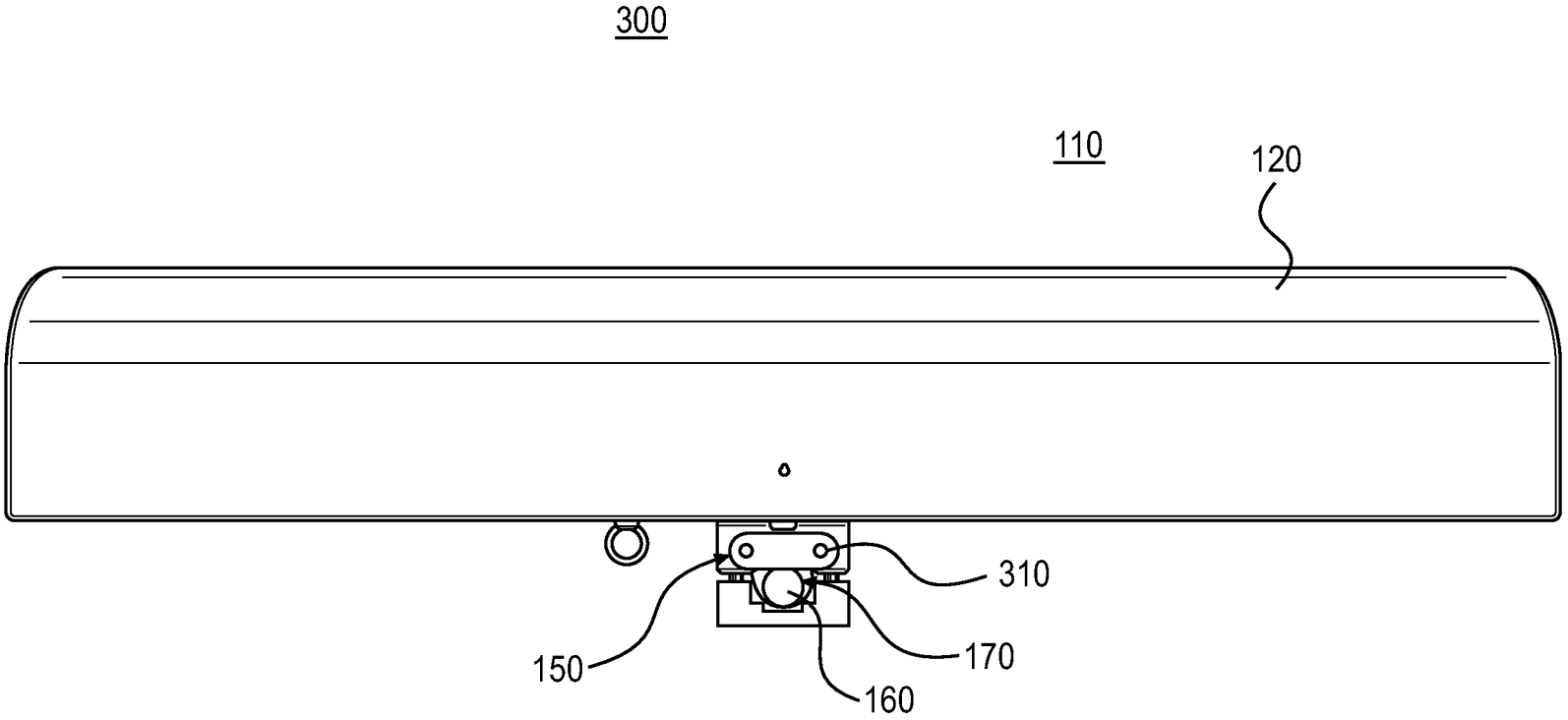
FIG. 3 illustrates a back plan view example of a luminaire apparatus with removable lighting modules.
Figure 4:
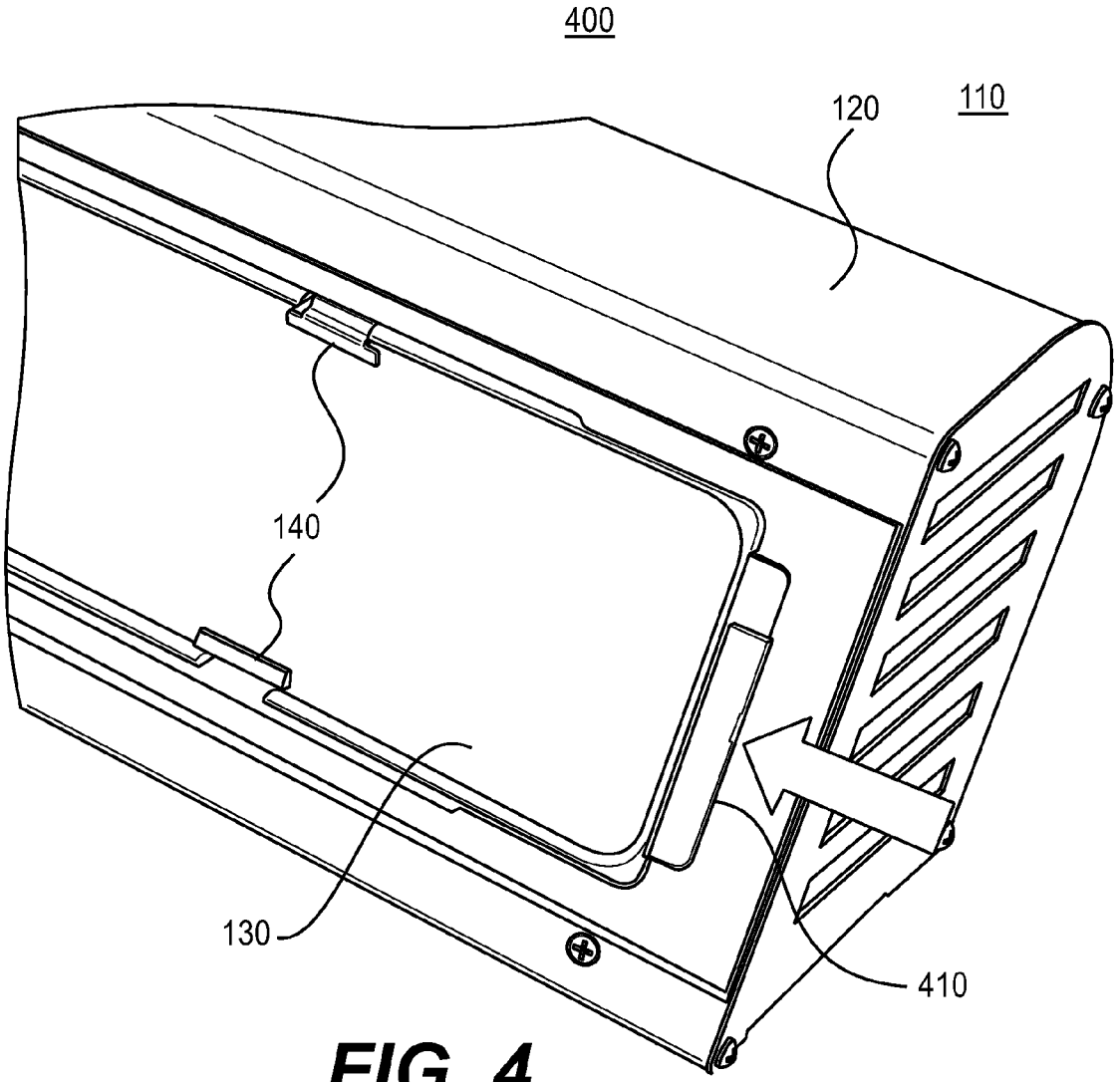
FIG. 4 illustrates a plan view example of a connection point between a luminaire apparatus and a removable lighting module.
Figure 5:
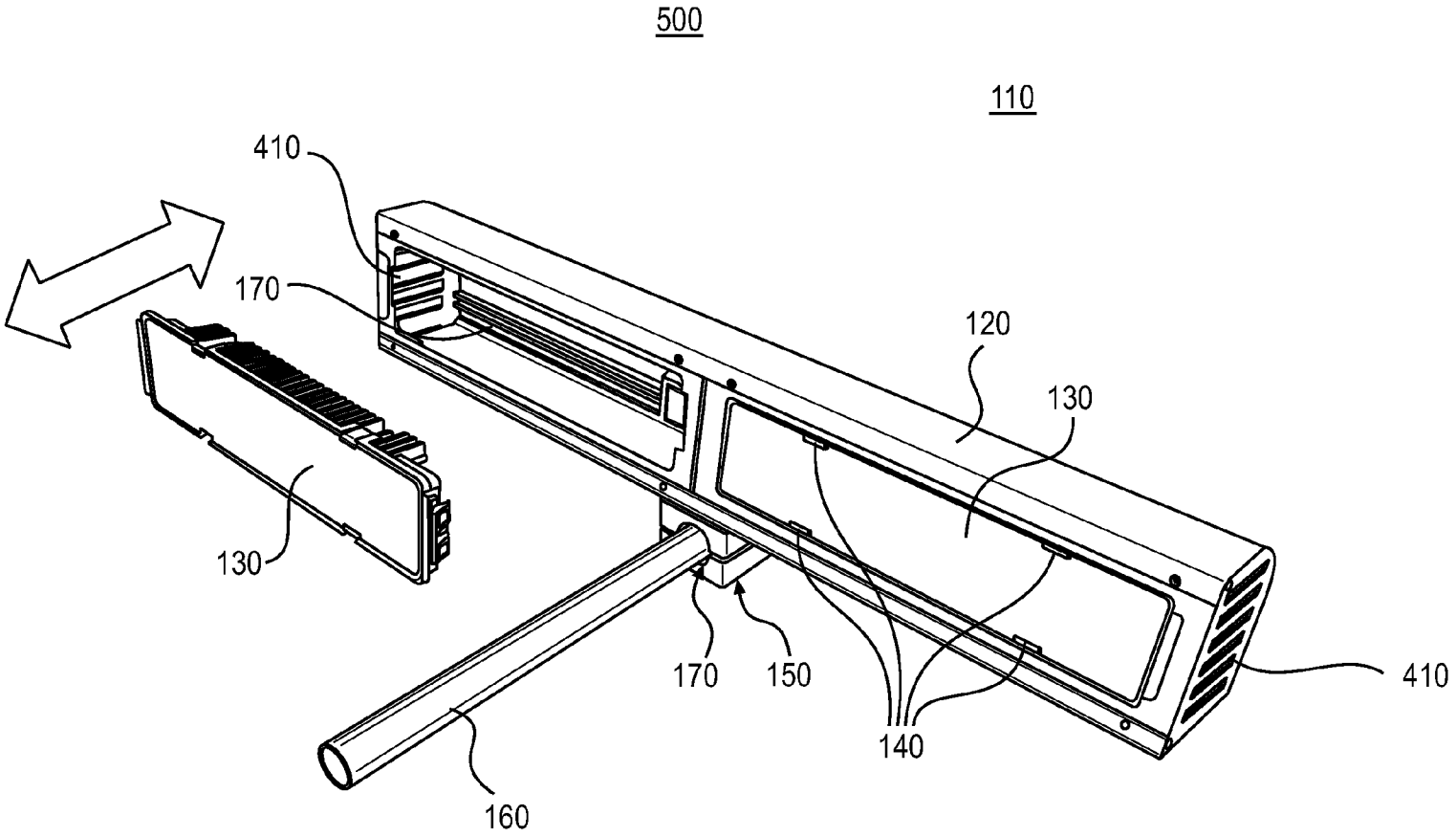
FIG. 5 illustrates a plan view example of an operation of connecting a luminaire apparatus with removable lighting modules.

FIG. 1 illustrates a plan view example 100 of the luminaire apparatus 110 with the removable lighting modules 130. FIG. 2 illustrates a front plan view example 200 of a luminaire apparatus 110 including the removable lighting modules 130. FIG. 3 illustrates a back plan view example 300 of a luminaire apparatus 110 including the removable lighting modules 130. FIG. 4 illustrates a plan view example 400 of a connection point 410 between the luminaire apparatus 110 and the removable lighting module 130. FIG. 5 illustrates a plan view example 500 of an operation of connecting a luminaire apparatus 110 with the removable lighting modules 130.

Figure 6:
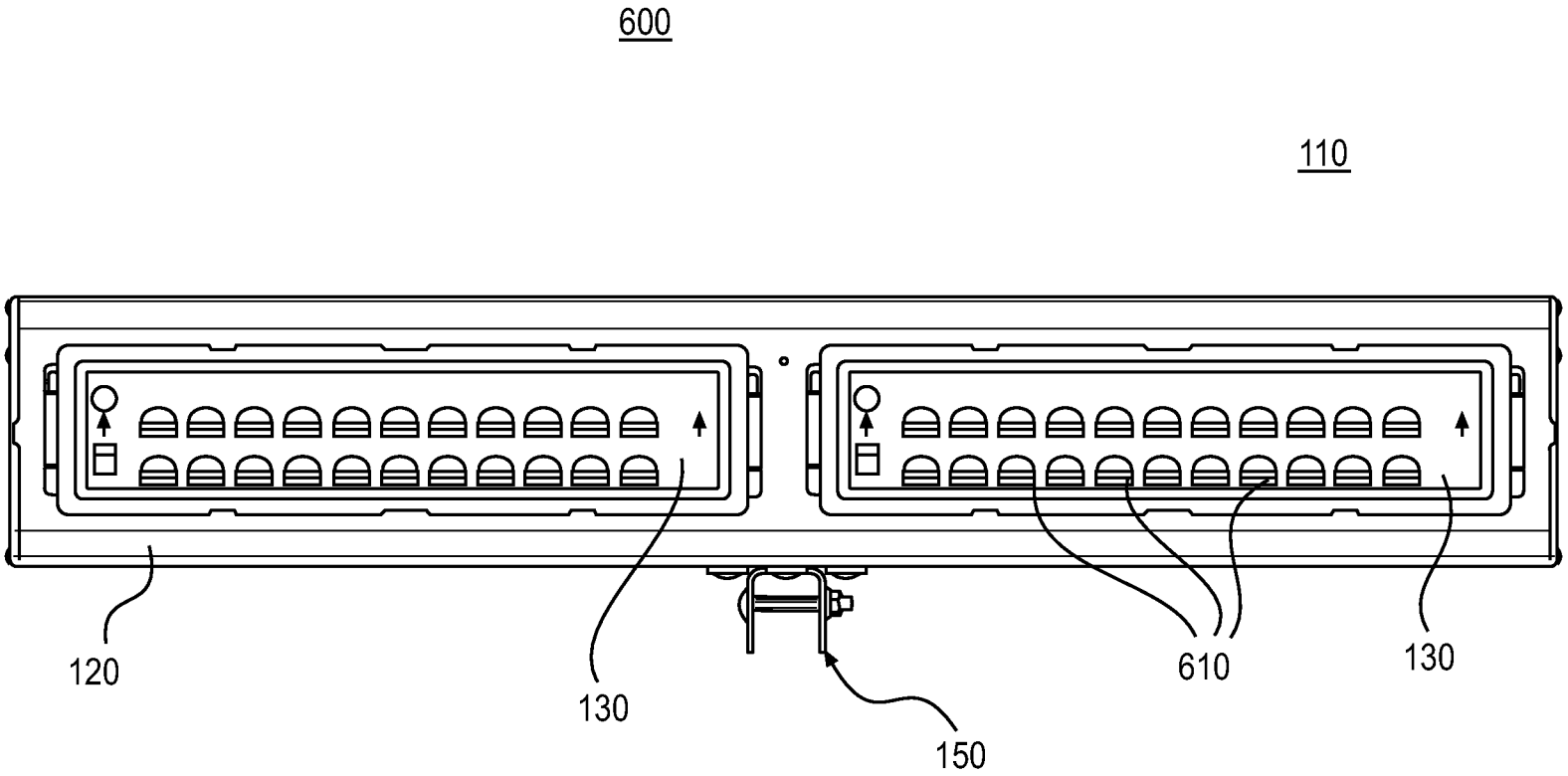
FIG. 6 illustrates another plan view example of a luminaire apparatus with removable lighting modules.
Figure 7:
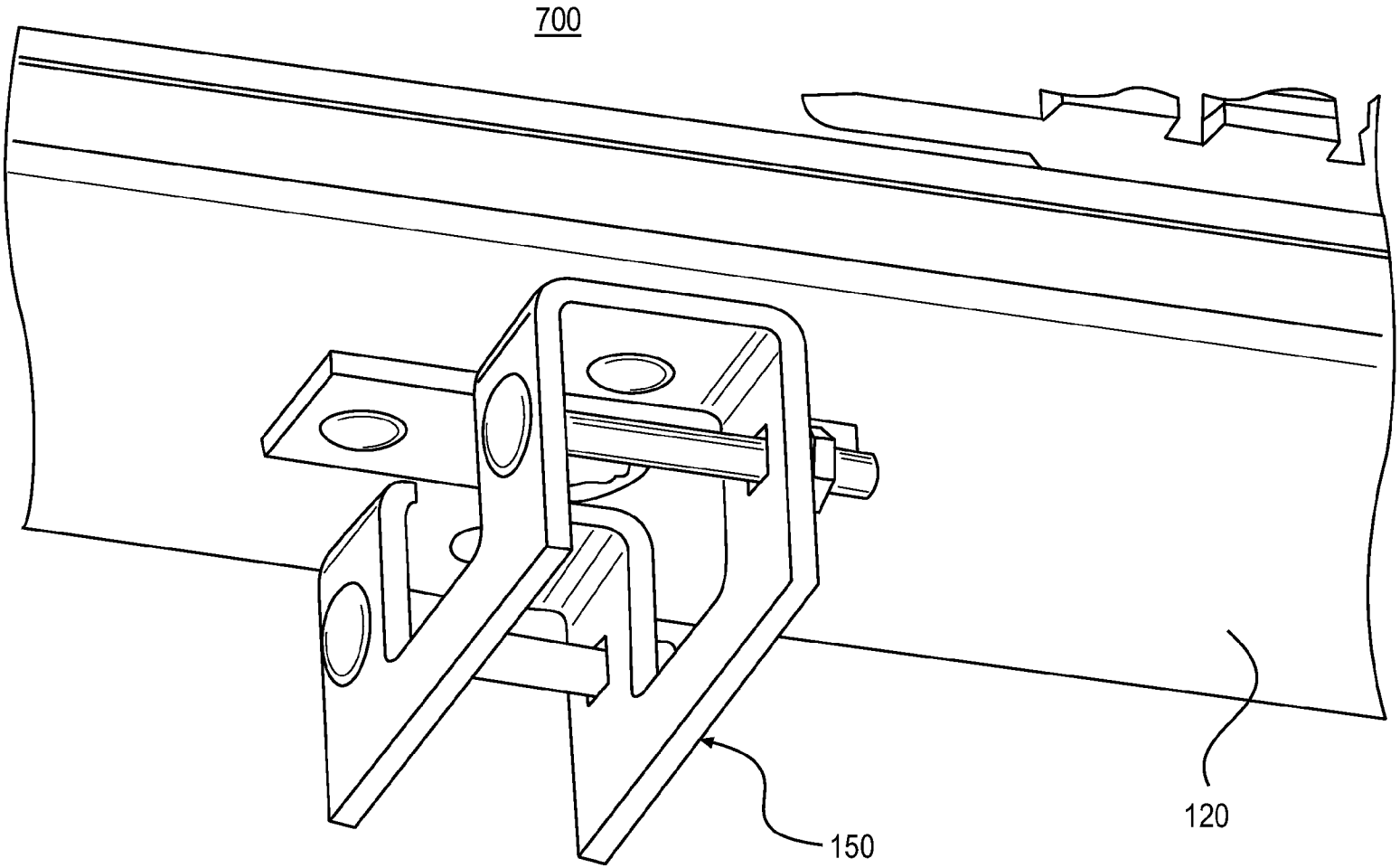
FIG. 7 illustrates a plan view example of a housing mounting member for a luminaire apparatus with removable lighting modules.
Figure 8:
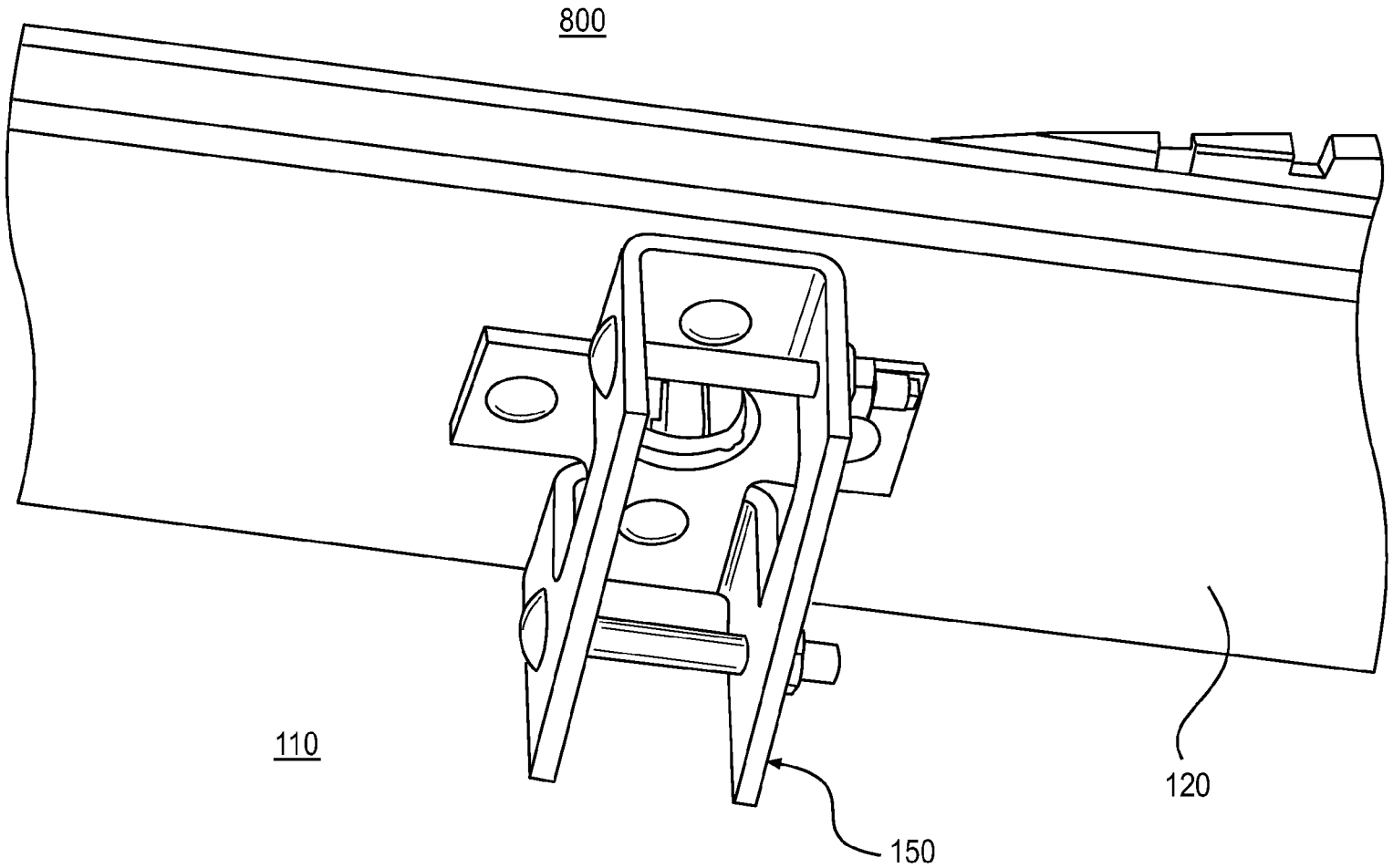
FIG. 8 illustrates another plan view example of a housing mounting member for a luminaire apparatus with removable lighting modules.
Figure 9:
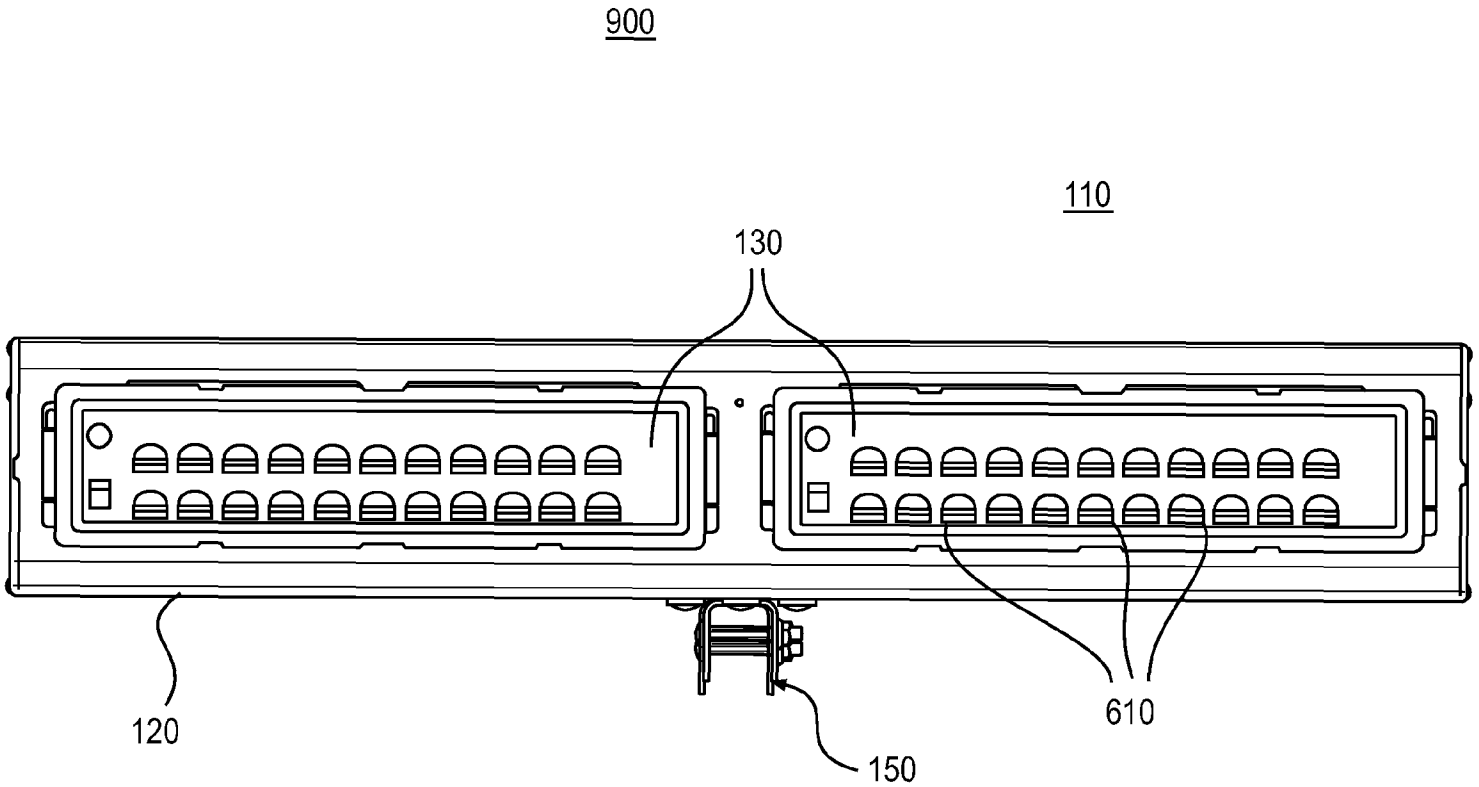
FIG. 9 illustrates another plan view example of a luminaire apparatus with removable lighting modules.
Figure 10:
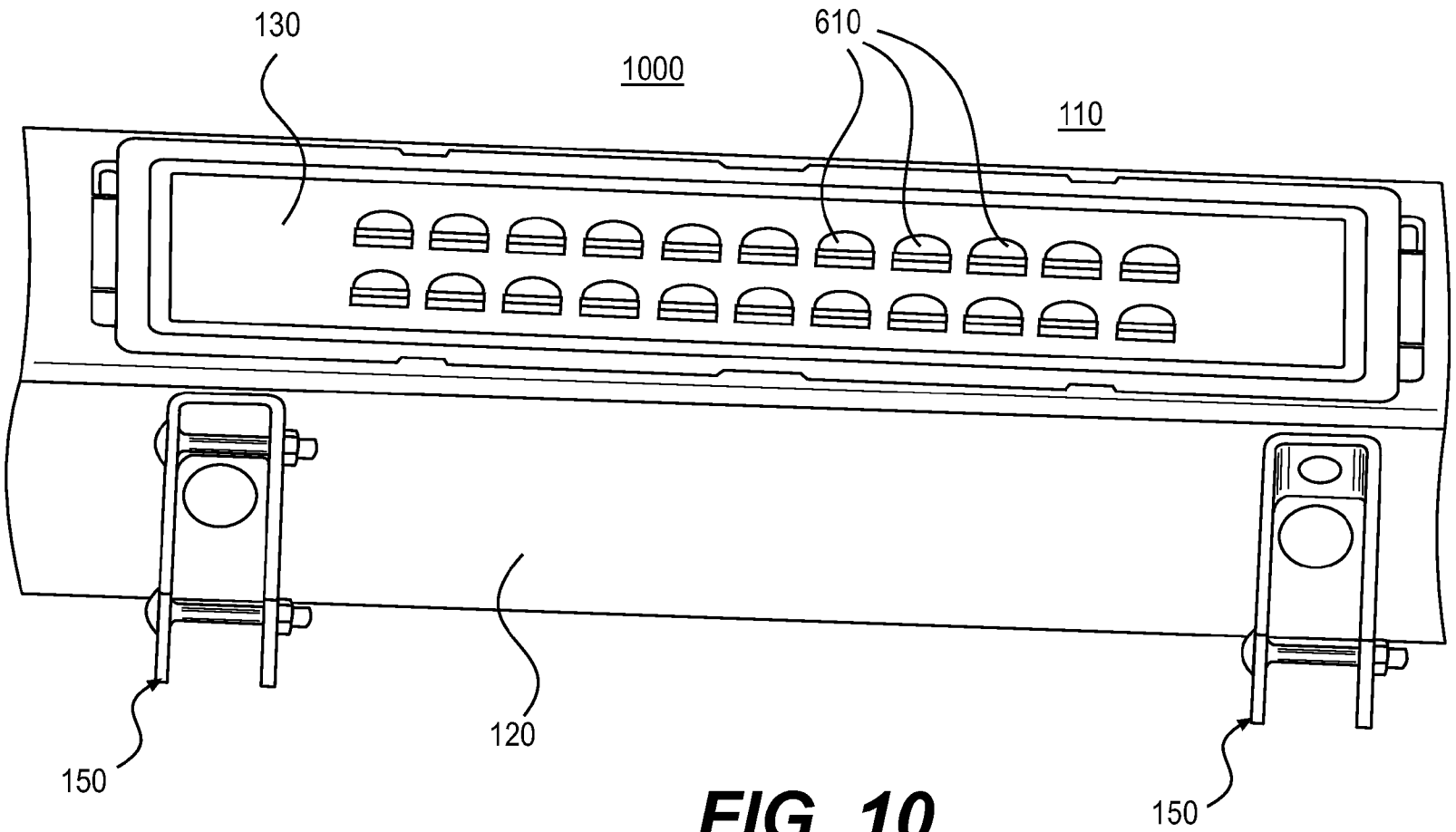
FIG. 10 illustrates a plan view example of attachment points for a housing mounting member of a luminaire apparatus with removable lighting modules.

FIG. 6 illustrates a plan view example 600 of the luminaire apparatus 110 with light module housing 120, the removable lighting modules 130, the housing mounting member 150, and LEDs 610. FIG. 7 illustrates a plan view example 700 of the luminaire apparatus 110 with light module housing 120, and the housing mounting member 150. FIG. 8 illustrates another plan view example 800 of the luminaire apparatus 110 with light module housing 120, and the housing mounting member 150. FIG. 9 illustrates a plan view example 900 of the luminaire apparatus 110 with light module housing 120, the removable lighting modules 130, the housing mounting member 150, and LEDs 610. FIG. 10 illustrates another plan view example 1000 of the luminaire apparatus 110 with light module housing 120, the removable lighting modules 130, the housing mounting member 150, and LEDs 610.

Figure 11:
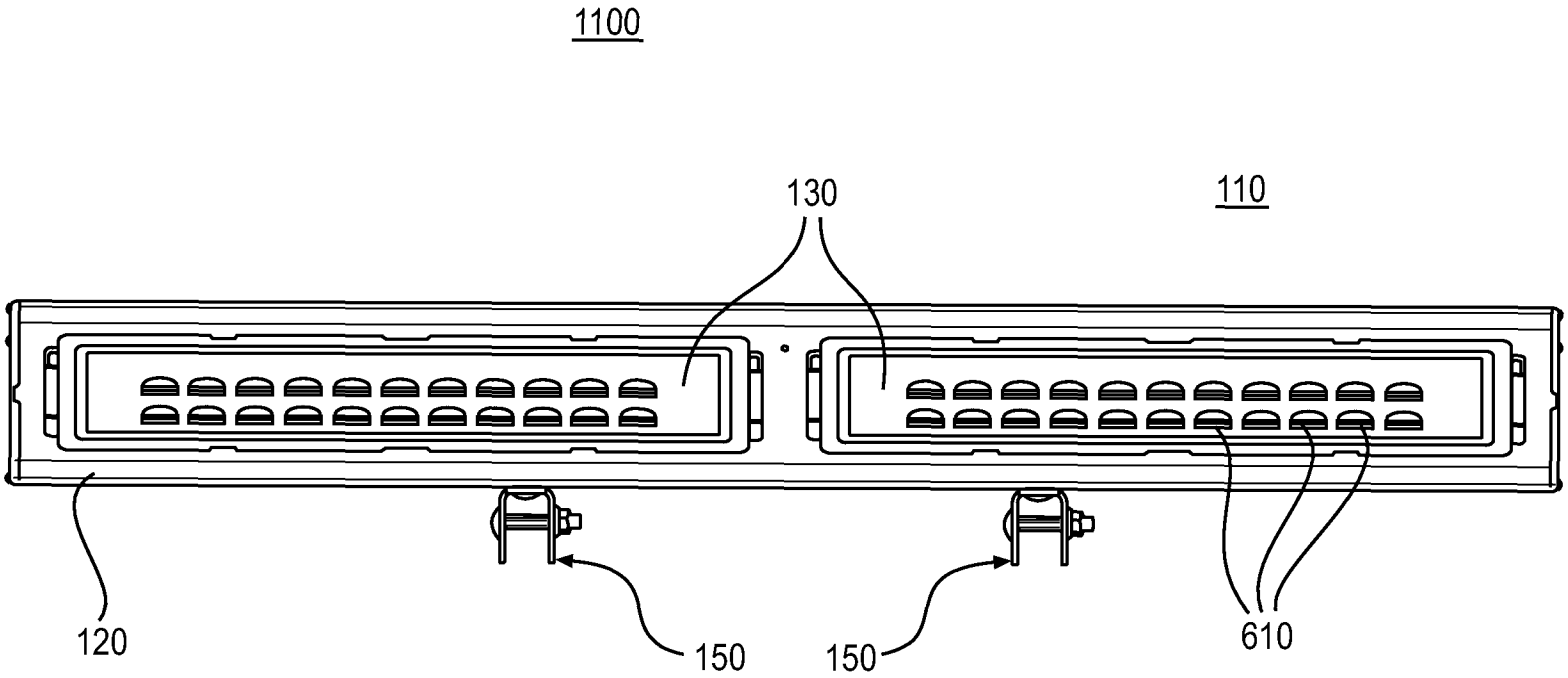
FIG. 11 illustrates another plan view example of a luminaire apparatus with removable lighting modules.
Figure 12:
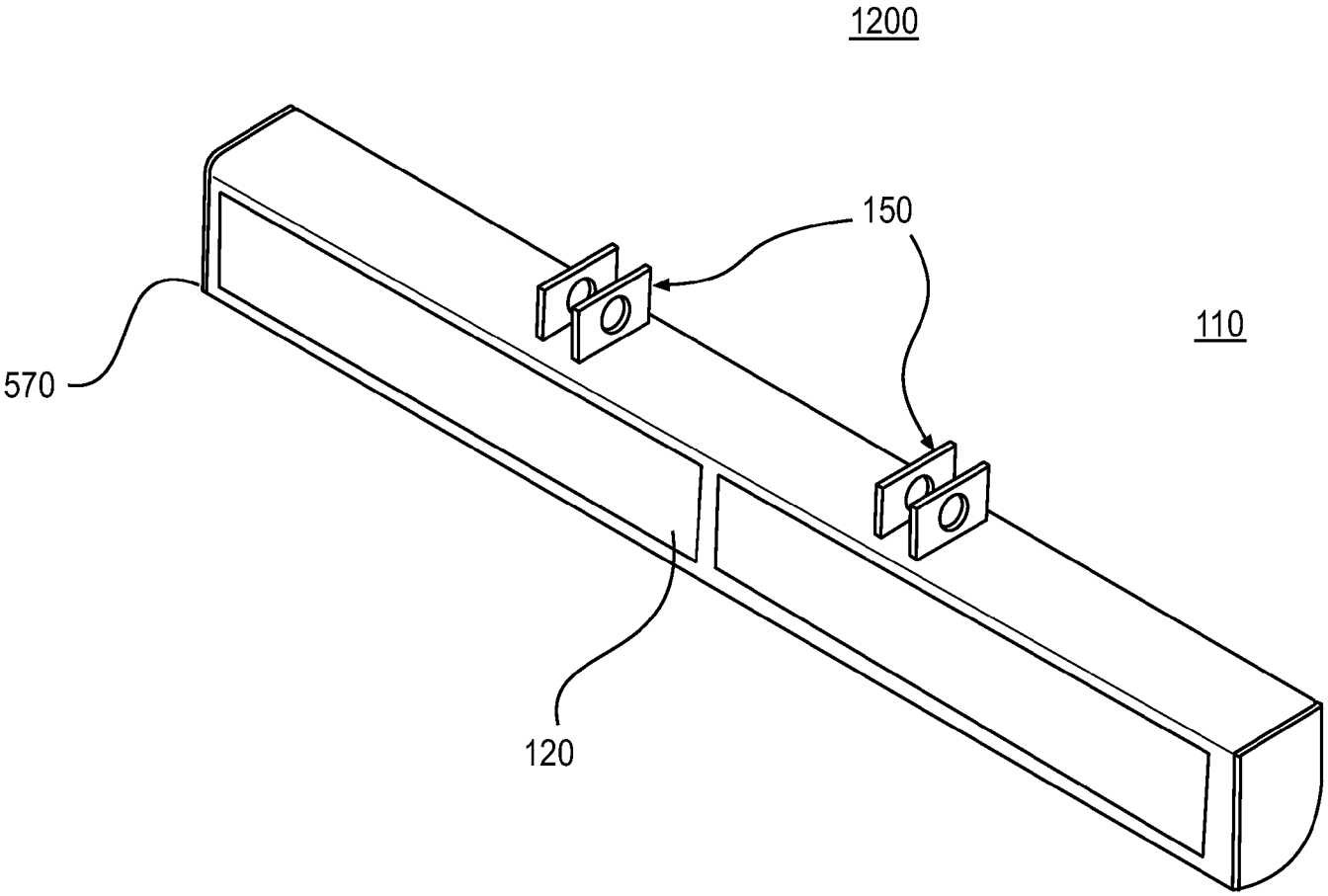
FIG. 12 illustrates another plan view example of a luminaire apparatus with removable lighting modules.
Figure 13:
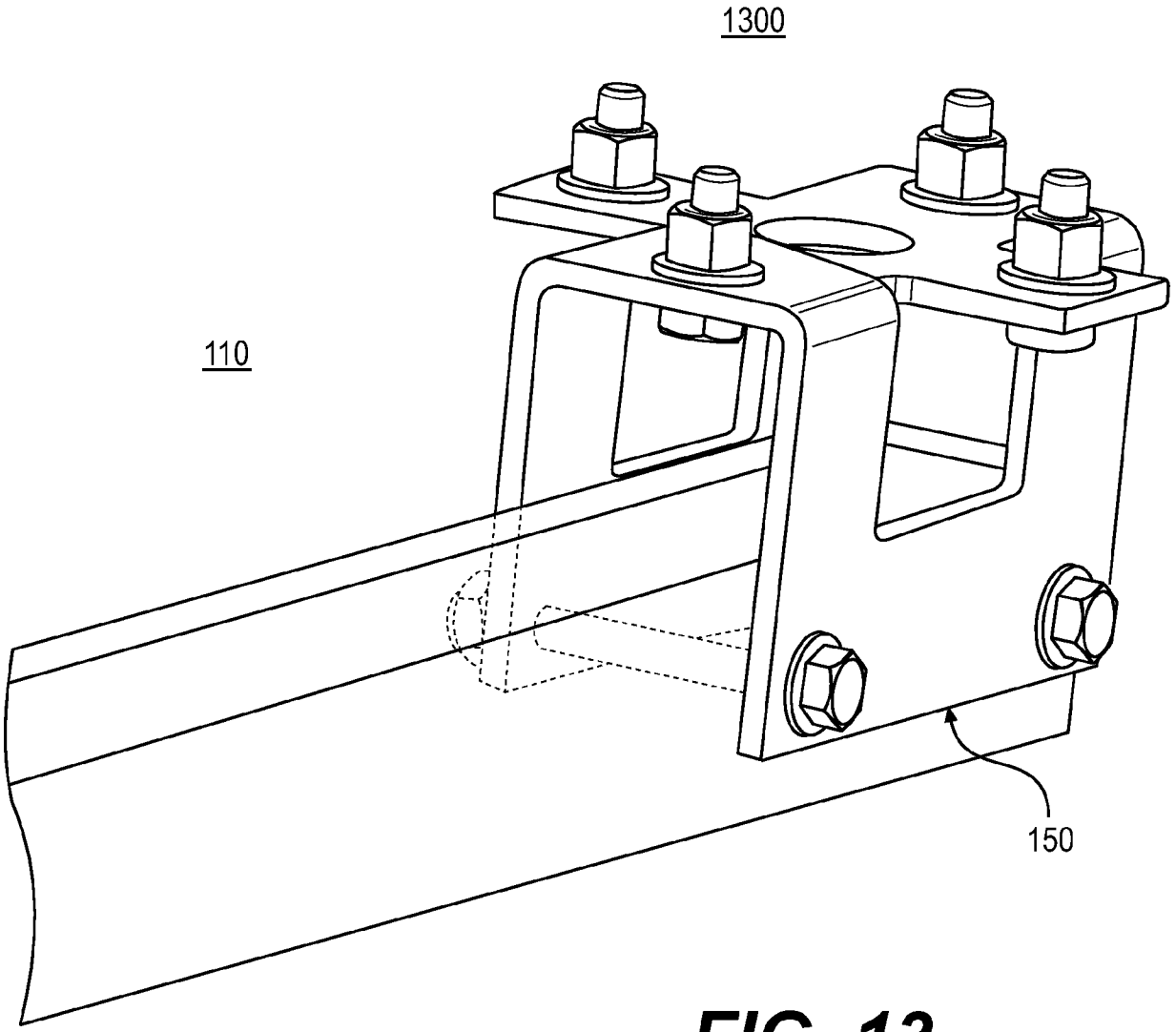
FIG. 13 illustrates another plan view example of a housing mounting member for a luminaire apparatus with removable lighting modules.
Figure 14:
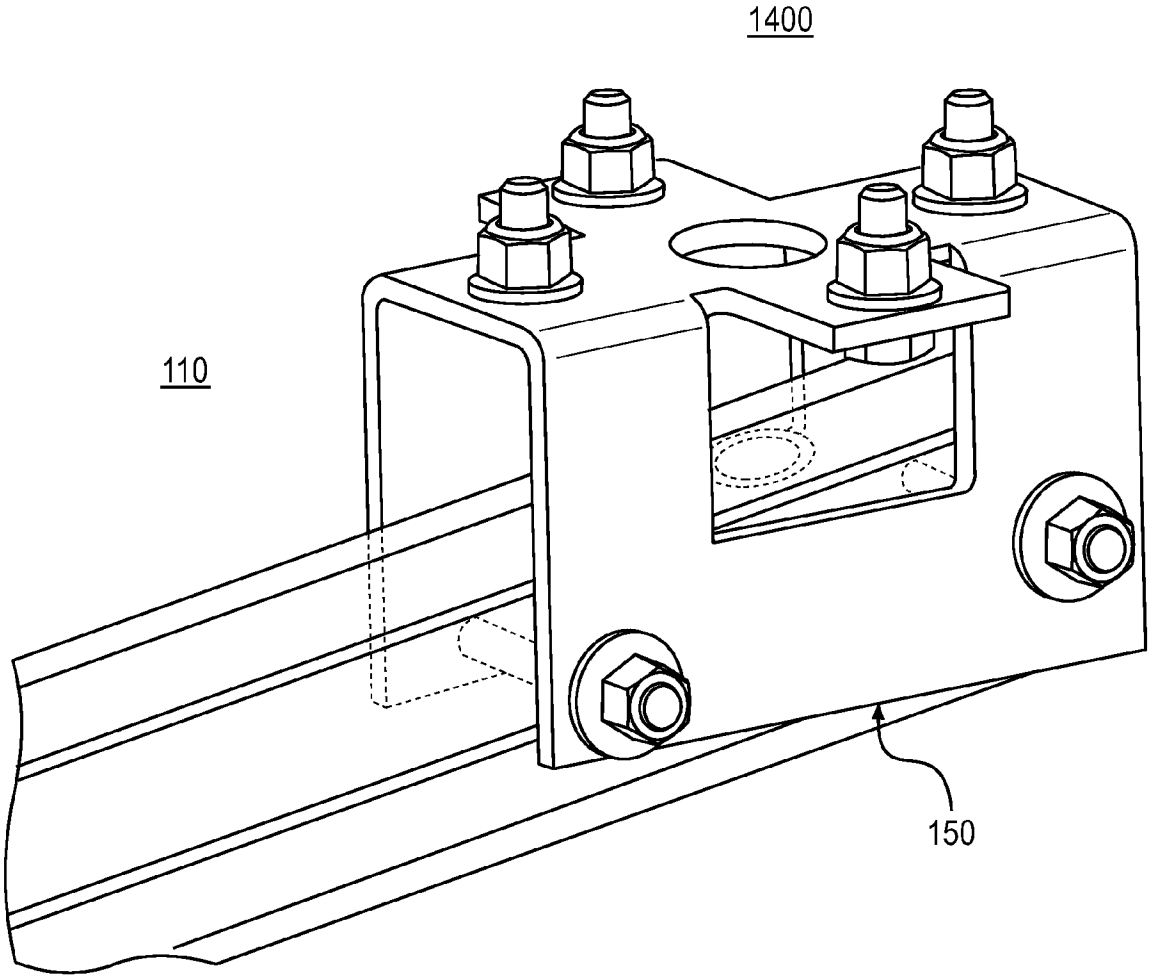
FIG. 14 illustrates another plan view example of a housing mounting member for a luminaire apparatus with removable lighting modules.
Figure 15:
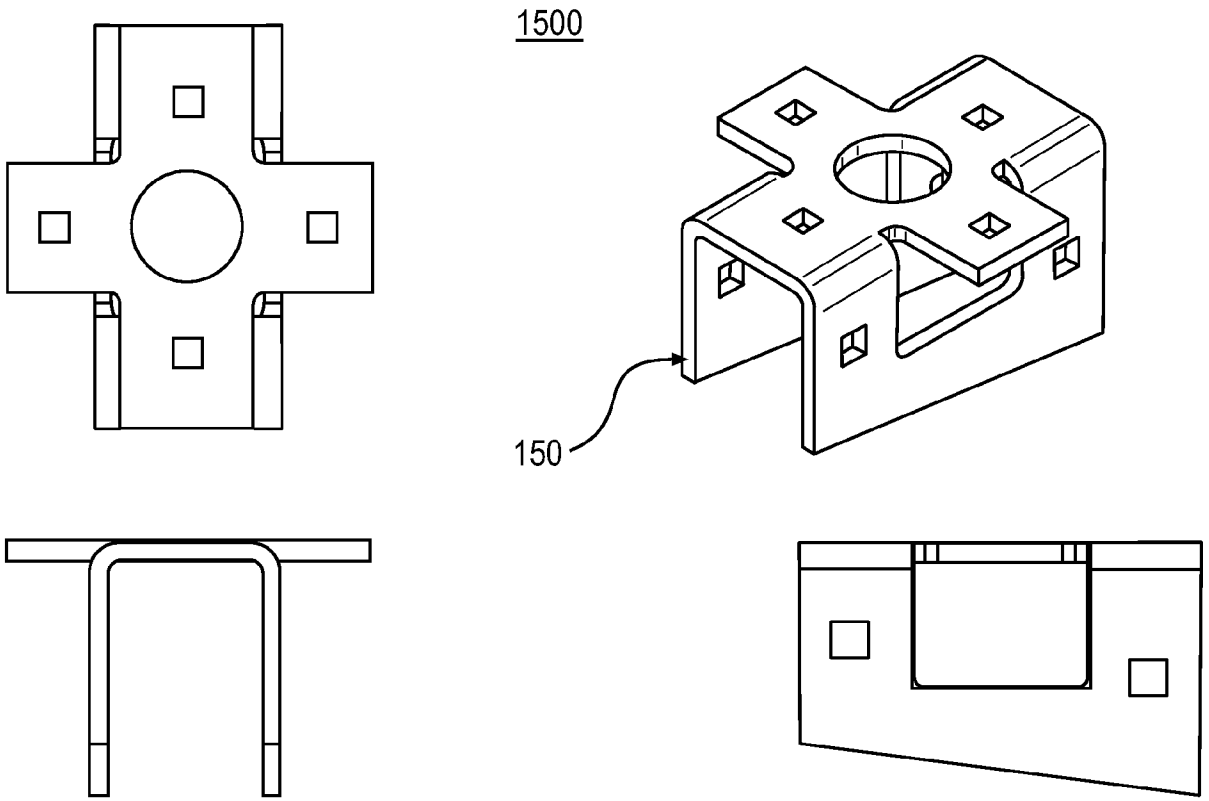
FIG. 15 illustrates another plan view example of a housing mounting member for a luminaire apparatus with removable lighting modules.
Figure 16:
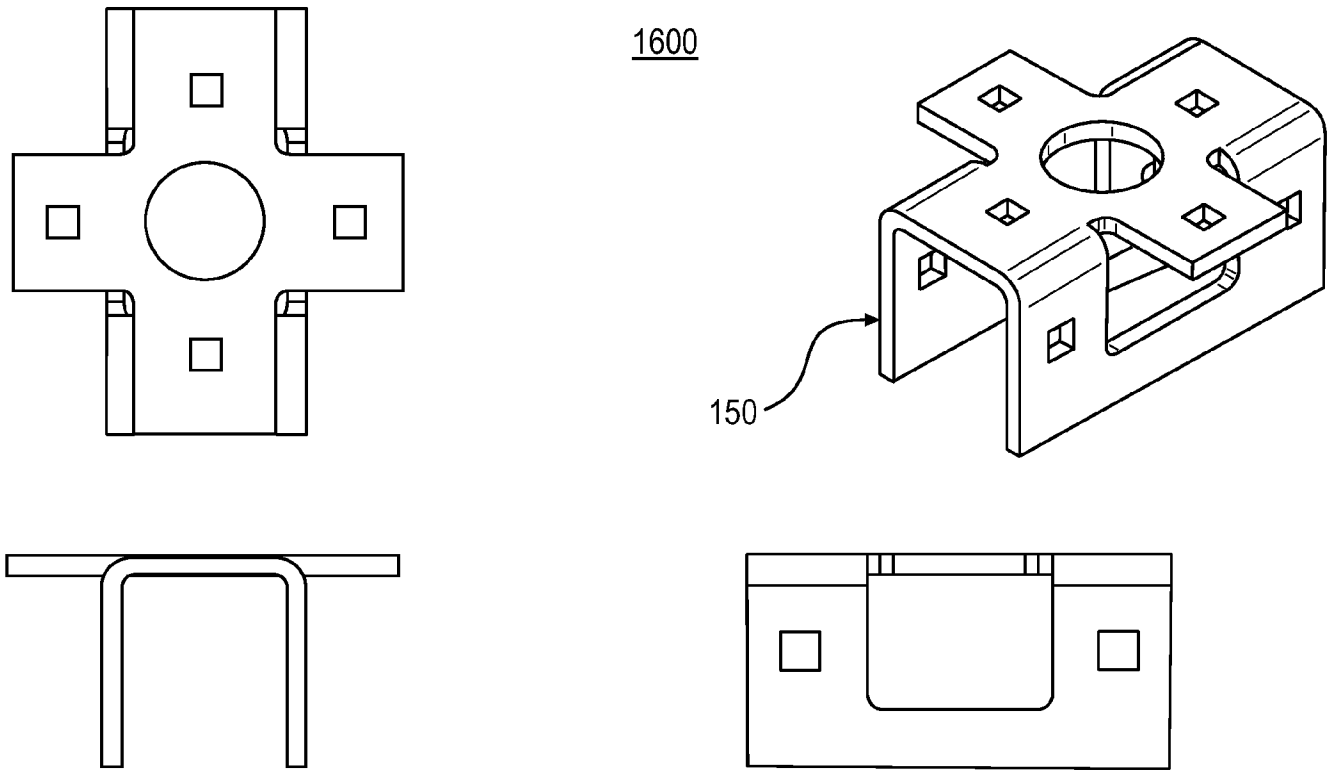
FIG. 16 illustrates another plan view example of a housing mounting member for a luminaire apparatus with removable lighting modules.

FIG. 11 illustrates another plan view example 1100 of the luminaire apparatus 110 with light module housing 120, the removable lighting modules 130, the housing mounting member 150, and LEDs 610. FIG. 12 illustrates another plan view example 1200 of the luminaire apparatus 110 with light module housing 120, the light module recess 570, and the housing mounting member 150. FIG. 13 illustrates another plan view example 1300 of the luminaire apparatus 110 with the housing mounting member 150. FIG. 14 illustrates another plan view example 1400 of the luminaire apparatus 110 with the housing mounting member 150. FIG. 15 illustrates another plan view example 1500 of the housing mounting member 150 at different angles. FIG. 16 illustrates another plan view example 1600 of another housing mounting member 150 at different angles.

Referring to FIGS. 1-2, the luminaire apparatus 110 includes a light module housing 120 including a light module recess 570 (shown in FIG. 5), which is configured to attach to the removable lighting modules 130. The removable lighting modules 130 are releasably attached to the light module housing 120. Indeed, the removable lighting modules 130 are configured to be disposed within the light module recess 570, as discussed below. In one illustrative example, the surface of the removable lighting modules 130 are fabricated as glass or tempered glass, while light module housing 120 is made of aluminum, glass and stainless steel components.

Though FIGS. 1-2 only illustrates two removable lighting modules, any number of lighting modules may be releasably attached to the light module housing 120 via the light module recess 570. For example, two, three, or any number of lighting modules may be attached to the light module housing 120.

Furthermore, the light module housing 120 includes the removable lighting modules 130, which are releasably attached to the light module housing 120 via the mounting brackets at specific attachment points. The attachment points correspond to the number of mounting brackets in order for safe assurance of attaching the removable lighting modules 130 to the light module housing 120.

The face of the light module housing 120 and the removable lighting modules 130 are configured to be positioned parallel or substantially parallel to an object (not shown) such as a billboard, parking wall, warehouse wall, retail space wall, outdoor sign and the like. In one illustrative example, substantially parallel may be extending in the same direction and equidistant to the object with a small or negligible inclination of 5 to 20 degrees. By placing the plurality of removable lighting modules in parallel to the object, the chance of environmental impact from snow, wind, and the like is greatly reduced.

The light module housing 120 is also configured to be attached to the housing mounting member 150. The housing mounting member 150 is further configured to be releasably attached to a connection member via a connection member attachment arrangement recess 170 disposed in the housing mounting member 150. The housing mounting member 150 is further configured to attach the light module housing 120 at a desired vertical or near vertical orientation. In one example, the top of the housing mounting member 150 is attached to the light module housing 120 at a central location of the light module housing 150. In another example, the housing mounting member 150 is attached to the light module housing 120 at other locations along the bottom of the light module housing 150.

In one example, the connection member is configured to connect the housing mounting member 150 to a billboard, parking wall, warehouse wall, retail space wall, or outdoor sign. The connection member extends away from the light module housing 120, perpendicular to a front face of the removable lighting module 130. The connection member may be positioned at a mid-point of the light module housing 120. In an alternative configuration, a pair of connection members may be included in which each connection member is positioned at an end point of the light module housing 120. In yet another configuration, a connection member may be positioned at a mid-point of each of the removable lighting module 130. This connection provides illumination of an object such as a billboard, parking wall, warehouse wall, retail space wall, or outdoor sign via the luminaire.

The removable lighting modules 130 may also be configured to include a plurality of lights (not shown) configured to be oriented substantially parallel to the object, as discussed above. The plurality of lights may be a plurality of light emitting diodes (LEDs) that include a specific optic which directs light emanating from the plurality of LEDs. Indeed, the specific optic of the plurality of LEDs allows or enables the light emanating from the plurality of LEDs to illuminate an entirety of the object. It should be noted that the number of LEDs is not limited to any specific number but the number of LEDs should illuminate the entirety of the surface of the object.

Specifically, the LEDs within the luminaire and lighting modules described herein may have a specific optic capable of efficiently illuminating the entirety of the surface of the object. For example, one LED is capable of lighting the entirety of the surface of the object at $1/n^{th}$ of the total LEDs light power. As a result, the loss of one LED does not blacken a portion of the surface of the object, but merely reduces the total light by $1/n^{th}$ of the total light emitted over the surface of the object It should be noted that each of the light module housing 120, the light modules 130, and the housing mounting member 150 may be water tight so the housing may be open to the air such that the luminaire fixture is not sealed and the individual parts may be easily detached. This allows for greater thermal efficiency over conventional products in which the LEDs are sealed inside a complete one piece luminaire fixture.

In another aspect, referring to FIGS. 1-2, the light module housing 120 and the removable lighting modules 130 are configured to be releasably attached to the light module housing 120. The luminaire apparatus 110 also includes a plurality of LEDs (note shown) disposed within the lighting module 120 and a light emitting surface affixed to the lighting module 120. The light module housing 120, the removable lighting modules 130, and the light emitting surface 190 are configured to be oriented substantially vertically and to be oriented substantially parallel to an object, thereby reducing interference from the surrounding environment. Indeed, the vertical orientation of the lighting module 120 and the light emitting surface 190 reduces interference from a surrounding environment when the LEDs illuminate the object. For example, the vertical orientation of the lighting module 120 and the light emitting surface 190 greatly reduces the impact from wind, snow, the buildup of snow, and the like on the lighting module 120 and the light emitting surface 190 to emit light onto an object.

Furthermore, the LEDs in the removable lighting modules 130 emit light through the light emitting surface 190 without interference from a surrounding environment. As discussed above, the LEDs include a specific optic that directs light emanating from the LEDs. Therefore, the specific optic of the LEDs allows the LEDs to illuminate an entirety of the object.

For example, existing industry luminaires products have LEDs that are individually pointed at an object in various angles to illuminate only portions of the surface the object. However, in the configurations of FIGS. 1-2, the LEDs within the luminaire and light module described herein may have a specific optic capable of efficiently illuminating the entirety of the surface of the object. For example, one LED is capable of lighting the entirety of the surface of the object at $1/n^{th}$ of the total LEDs light power. As a result, the loss of one LED does not blacken a portion of the surface of the object but merely reduces the total light by $1/n^{th}$ of the total light emitted over the surface of the object.

Referring to FIG. 3, a luminaire apparatus 110 includes a light module housing 120 configured to be attached to the housing mounting member 150. The housing mounting member 150 is further configured to be releasably attached to a connection member via a connection member attachment arrangement recess 170 disposed in the housing mounting member 150. The light module housing 120 is connected to housing mounting member 150 via attachment device 310, which is configured to attach the light module housing 120 to housing mounting member 150.

Referring to FIG. 4, the lighting modules 130 are secured to the light module housing 120 using spring clips 410. The spring clips 410 are used to physically couple the lighting modules 130 to the light module housing 120 without having to use tools. Further, the spring clips 410 are configured to remove the lighting modules 130 from the light module housing 120 easily and effectively by simply pressing down onto the spring clips 410. For example, a user may press down onto spring clip 410 at a position highlighted by arrow of FIG. 4 to remove a lighting module from the light module housing 120.

Referring to FIG. 5, a luminaire apparatus 110 includes a light module housing 120 including a light module recess 570 that is configured to attach to the removable lighting modules 130. As shown, the removable lighting member 130 is releasably attached to the light module housing 120 via the spring clip 410. For example, the removable lighting module 130 attaches to the light module recess 570 via the spring clip 410. The removable lighting module 130 may be removed from the light module housing 120 in the direction shown by the multi-directional arrow illustrated in FIG. 5.

Indeed, the lighting modules 130 may be secured to the light module housing 120 using the spring clips 410. The spring clips 410 may be used to physically couple the lighting modules 130 to the light module housing 120 without the use of tools. Further, the spring clips 410 are configured to remove the lighting modules 130 from the light module housing 120 easily and effectively by simply pressing down onto the spring clips 410.

In another aspect, method installing a luminaire apparatus is disclosed that includes attaching a light module housing to the connection member, inserting a light module into the light module housing such that a light emitting surface of the light module is oriented substantially parallel to the object and the light module is configured to illuminate an entirety of the object.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims

What is claimed is:

1. A luminaire apparatus for illuminating an object, the luminaire apparatus comprising:

a first housing comprising light module recesses;

watertight lighting modules configured to be disposed within the light module recesses, configured to be oriented parallel to the object, and each comprising:

a plurality of light emitting diodes (LEDs) configured to be oriented parallel to the object, a specific optic configured to direct light emanating from the plurality of LEDs via a glass front surface of the lighting modules, a second housing, and heat sink fins extending from the second housing; and a housing mounting member attached to the first housing at a central location of the first housing, wherein the lighting modules are configured to attach to the first housing via spring clips and are configured to detach from the light module recesses, in response to a movement of the spring clips, in an opposite direction of a direction of the movement of the spring clips, wherein the first housing comprises vents configured to allow external air to flow over the heat sink fins, wherein a surface of the vents is substantially perpendicular to the glass front surfaces of the lighting modules, wherein a lengthwise direction of the lighting modules is parallel to a lengthwise direction of the first housing when the lighting modules are disposed within the first housing, wherein, when a first lighting module among the lighting modules and a second lighting module among the lighting modules are disposed within the first housing, the first lighting module is adjacent to a second lighting module in a longitudinal direction of the second lighting module, and wherein the housing mounting member is configured to be releasably attached to a connection member via a connection member attachment arrangement recess disposed in the housing mounting member.

2. The luminaire apparatus of claim 1, wherein the housing mounting member is configured to attach the first housing at a desired vertical or near vertical orientation.

3. The luminaire apparatus of claim 1, wherein the specific optic of the plurality of LEDs allows the light emanating from the plurality of LEDs to illuminate an entirety of the object.

4. The luminaire apparatus of claim 1, wherein the glass front surface of the lighting module is fabricated as tempered glass.

5. The luminaire apparatus of claim 1, further comprising a spring clip configured to allow the lighting module to be removed from the first housing without the need to remove the luminaire apparatus from its installed configuration.

6. A luminaire apparatus for illuminating an object, the luminaire apparatus consisting of:

a first housing comprising a light module recess;

a watertight lighting module configured to be disposed within the light module recess, configured to be oriented parallel to the object, and comprising:

a plurality of light emitting diodes (LEDs) configured to be oriented parallel to the object, a specific optic configured to direct light emanating from the plurality of LEDs via a glass front surface of the lighting module, a second housing, and heat sink fins extending from the second housing; and a housing mounting member attached to the first housing at a central location of the first housing, wherein the lighting module is configured to attach to the first housing via a spring clip and is configured to detach from the light module recess, in response to a movement of the spring clip, in an opposite direction of a direction of the spring clip movement, wherein the first housing comprises vents configured to allow external air to flow over the heat sink fins, wherein a surface of the vents is substantially perpendicular to the front surface of the lighting module, wherein a lengthwise direction of the lighting module is parallel to a lengthwise direction of the first housing when the lighting module is disposed within the first housing, and wherein the housing mounting member is configured to be releasably attached to a connection member via a connection member attachment arrangement recess disposed in the housing mounting member.

* * * * *